US010851790B2

(12) United States Patent
Darley

(10) Patent No.: US 10,851,790 B2
(45) Date of Patent: Dec. 1, 2020

(54) DOUBLE VOLUTE END SUCTION PUMP

(71) Applicant: W.S. Darley & Co., Itasca, IL (US)

(72) Inventor: Kyle Darley, Chippewa Falls, WI (US)

(73) Assignee: W.S. Darley & Co., Itasca, IL (US)

( * ) Notice: Subject to any disclaimer, the term of this patent is extended or adjusted under 35 U.S.C. 154(b) by 41 days.

(21) Appl. No.: 15/714,003

(22) Filed: Sep. 25, 2017

(65) Prior Publication Data

US 2018/0087512 A1 Mar. 29, 2018

Related U.S. Application Data

(60) Provisional application No. 62/400,435, filed on Sep. 27, 2016.

(51) Int. Cl.

| | |
|---|---|
| ***F04D 13/14*** | (2006.01) |
| ***F04D 1/00*** | (2006.01) |
| ***F04D 29/12*** | (2006.01) |
| ***F04D 29/62*** | (2006.01) |
| ***F04D 29/42*** | (2006.01) |

(52) U.S. Cl.

CPC ..... *F04D 1/006* (2013.01); *F04D 13/14* (2013.01); *F04D 29/126* (2013.01); *F04D 29/4293* (2013.01); *F04D 29/628* (2013.01)

(58) Field of Classification Search

CPC ..... F04D 1/006; F04D 13/14; F04D 29/126; F04D 29/628

See application file for complete search history.

(56) References Cited

U.S. PATENT DOCUMENTS

| | | | | |
|---|---|---|---|---|
| D940,871 | | 11/1909 | Guy | |
| 2,235,050 | A * | 3/1941 | Thege | F02B 33/00 123/41 R |
| 2,380,606 | A | 7/1945 | Moody | |
| 3,671,138 | A | 6/1972 | Ball | |
| 3,953,150 | A | 4/1976 | Onal | |
| 4,406,583 | A | 9/1983 | Becker et al. | |
| 4,563,124 | A | 1/1986 | Eskew | |
| 4,643,652 | A | 2/1987 | Eberhardt | |
| 4,929,149 | A * | 5/1990 | Greenspan | F04D 17/162 415/93 |
| 5,156,535 | A * | 10/1992 | Budris | F04D 13/06 277/405 |

(Continued)

FOREIGN PATENT DOCUMENTS

| | | | | |
|---|---|---|---|---|
| CN | 204113665 U | | 1/2015 | |
| GB | 938082 A | * | 9/1963 | F04D 15/0072 |

OTHER PUBLICATIONS

Sulzer, HZB Double Suction Volute Pump, Brochure, www.sulzer.com, 6 pages, 2014, USA.

(Continued)

*Primary Examiner* — Justin D Seabe
*Assistant Examiner* — Michael L Sehn
(74) *Attorney, Agent, or Firm* — Anthony J. Bourget

(57) ABSTRACT

A pump having two impellers driven by a common drive shaft where the impellers have suction inlets facing each other and are configured to axially receive fluid from a common chamber. A direct line path exists between suction inlets of the respective impellers. A mechanical seal having a two-piece housing is positioned with a first cup component of the housing fastened at an inboard side of an outboard head of the pump.

25 Claims, 10 Drawing Sheets

(56) References Cited

U.S. PATENT DOCUMENTS

| | | | | |
|---|---|---|---|---|
| 5,857,841 | A * | 1/1999 | Kobayashi | F04D 1/006 417/350 |
| 6,267,016 | B1 * | 7/2001 | Call | G01N 1/2273 73/863.22 |
| 6,514,053 | B2 * | 2/2003 | Takura | F04D 1/006 415/102 |
| 7,517,186 | B2 | 4/2009 | Seitz et al. | |
| 8,517,012 | B2 * | 8/2013 | Daly | A61M 16/0057 128/204.18 |
| 9,080,572 | B2 | 7/2015 | Murray | |
| 2007/0280823 | A1 * | 12/2007 | Kanemori | F04D 29/167 415/170.1 |

OTHER PUBLICATIONS

PCT International Searching Authority, Notification of Transmittal of the International Search Report and The Written Opinion of the International Searching Authority, or the Declaration, dated Dec. 19, 2017, p. 1-11, USA.

* cited by examiner

DOUBLE VOLUTE END SUCTION PUMP

CROSS-REFERENCE TO RELATED APPLICATIONS

This application claims the benefit and priority of Provisional Patent Application Ser. No. 62/400,435, filed Sep. 27, 2016, for DOUBLE VOLUTE END SUCTION PUMP, incorporated herein by reference in its entirety for continuity of disclosure.

BACKGROUND OF THE INVENTION

1. Field of the Invention

The present invention relates to centrifugal pumps and more particularly to pumps having two impellers powered by a single drive shaft.

2. Background Information

There are some centrifugal pumps known as double-suction-type pumps. Such pumps typically have an inlet passage which is split into two channels which divide and direct the incoming flow into two inlet passages. The inlet passages typically feed each side of the impeller. Examples of such single impeller double suction pumps can be found, for instance, in U.S. Pat. Nos. 4,563,124, 3,953,150, and 4,643,652. A double suction pump having an inlet passage split into two channels which separately feed two opposed impellers on a common drive shaft is found in China Patent No. CN204113665. While such double suction pumps may have useful features, there is room for improvement.

SUMMARY OF THE INVENTION

Applicant has developed a double impeller end suction pump where opposing impellers are separated from each other and driven by a common drive shaft and where the impellers are fed by a common, single inlet source. Each impeller is fed axially or in an end-suction manner which allows for increased lift pressure while a commonly shared chamber of inlet fluid provides a desired balance for fluid input into the respective impellers.

In further aspects the pump includes a mechanical seal associated with the outboard impeller where the mechanical seal is positioned within a two-piece housing, the housing having a first cup component mounted to an inboard side of the outboard head and a second cover component mounted to the first cup component with a weld spring contained within the two-piece housing. Such two-piece housing facilitates efficient and accurate assembly of the outboard head while assuring a proper seal.

In further aspects the invention includes a pump having two impellers driven by a common shaft and axially receiving suction fluid from a common chamber and incorporating seal rings adjacent the impellers to assure a great lift or displacement potential through a common discharge.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
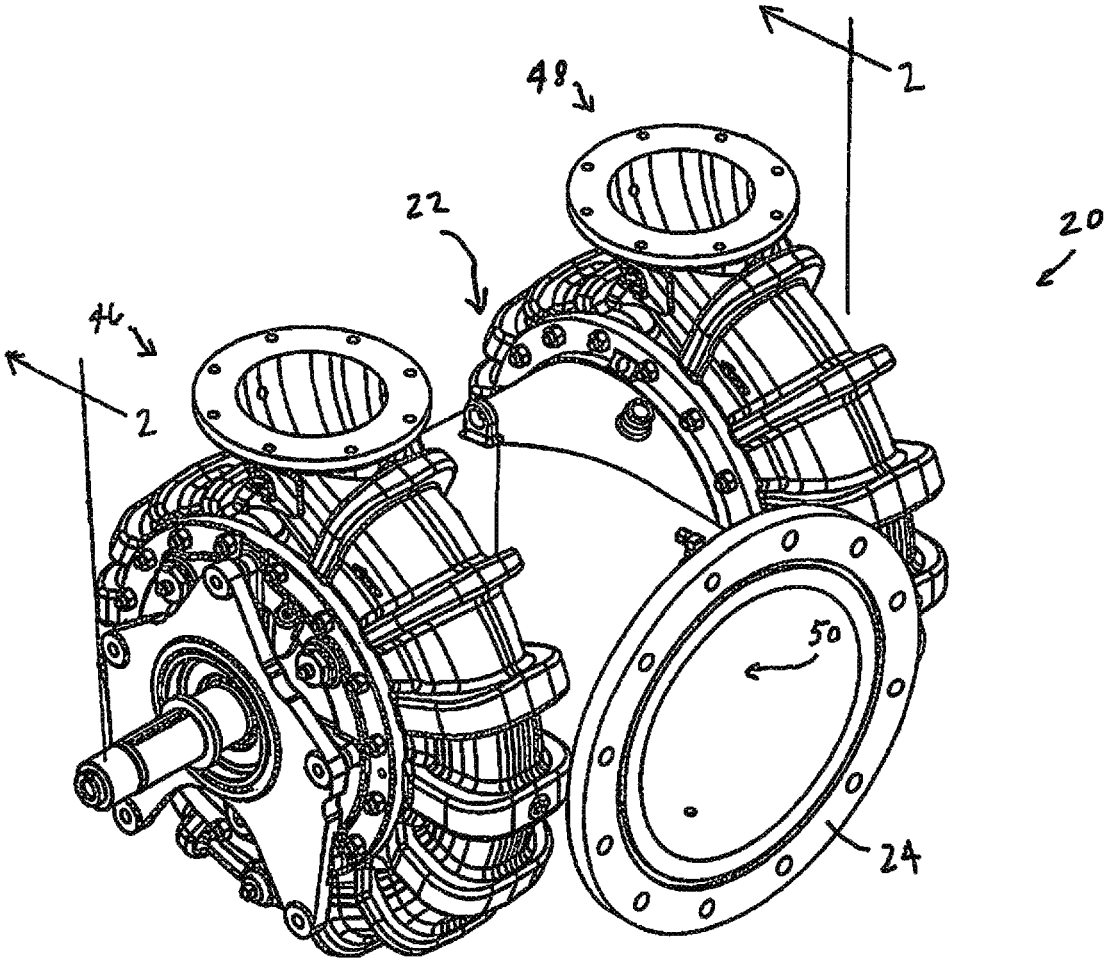
FIG. 1 is a perspective view of a pump in accordance with one aspect of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Referring to FIGS. 1-10, aspects of the pump are shown. In one aspect, pump 20 includes a suction head 22 having a flange 24 for mounting to a fluid supply line. Head 22 in one aspect is generally "T" shaped. Head 22 has a first side 26 and an opposite second side 28. A first impeller 36 is positioned at first side 26 and a second impeller 38 is positioned at second side 28. A drive shaft 30 passes through suction head 22. The drive shaft 30 is configured to drive impellers 36, 38. Drive shaft 30 is driven via a gearbox 32 (FIG. 5) which is typically connected to a drive line of a vehicle such as a fire truck or firefighting apparatus. Each of the impellers 36, 38 is positioned within a respective pump casing 46, 48. Each pump casing has a respective discharge 47, 49. Each of the impellers 36, 38 is configured to be axially fed fluid via a single common inlet chamber 50. Particularly, fluid, such as water or other fluid, is fed through a supply line connected to flange 24 such that the fluid enters chamber 50 and then into the suction inlet 42 of a respective impeller. As may be appreciated, the drive shaft 30 moves the impellers 36, 38 to simultaneously actively displace fluid. As may be appreciated, the impellers 36, 38 simultaneously displace fluid in the same direction through respective discharge 47, 49.

Figure 2:
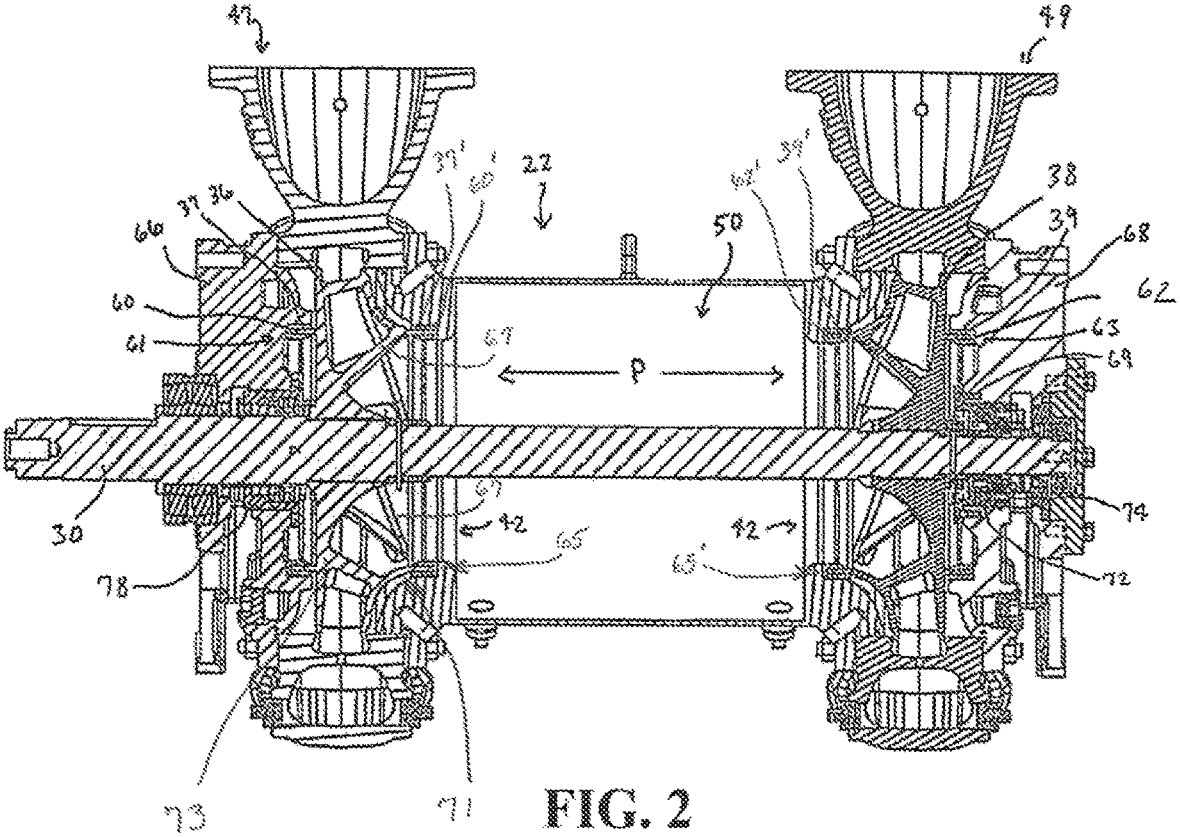
FIG. 2 is a section view taken along line 2-2 of FIG. 1.
Figure 3:
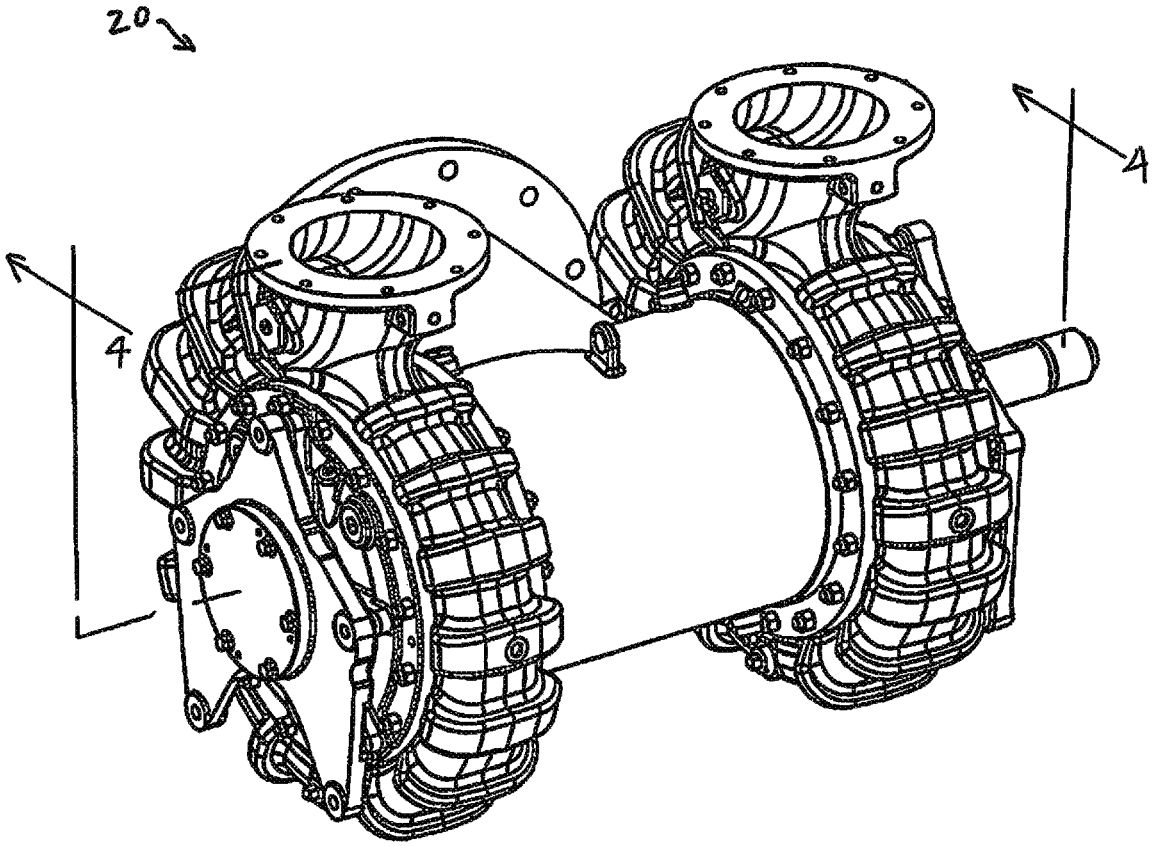
FIG. 3 is a rear perspective view of the pump of FIG. 1.

As shown in FIG. 2, for instance, a suction inlet 42 of impeller 36 faces a suction inlet 42 of impeller 38. In this arrangement fluid that enters chamber 50 is free to be directed to either or both impeller 36, 38 depending on the internal flow characteristics and pressures presented in chamber 50. Such flow characteristics and pressures are influenced by the volume being displaced by respective impellers, the respective speeds of the impellers, the downstream flow rates or obstructions at the discharge lines, among other factors. For instance, while shaft 30 may be spinning such that impellers are spinning at the same velocity, the fluid volume and pressure within a downstream line associated with one impeller/casing may be different compared to the fluid volume and pressure within a downstream line associated with the other impeller such that fluid entering chamber 50 may tend to be influenced toward one impeller over the other. This allows for a self-adjusting of the flow within chamber 50 and does not restrict the fluid to proceed along a dedicated water path toward respective impellers.

As shown in FIG. 2, a direct line path "P" extends within suction head 22 and between a suction inlet 42 associated with impeller 36 and a second suction inlet 42 associated with impeller 38. The direct line path "P" is devoid of obstruction. For instance, path "P" is a direct line between respective impellers 36, 38. There is an absence of casting elements between the inlets 42 to the impellers 36, 38. In one instance path "P" is a horizontal path. The entirety of shaft 30 (or, as explained below, nearly the entirety of the shaft 30) between respective impellers 36, 38 is exposed within chamber 50. For instance, but for the nut and collar portions holding the respective impellers 36, 38 to the shaft 30, there are no other components within chamber 50 which contact shaft 30 or through which shaft 30 passes. This portion of shaft 30 is exposed within the inlet chamber 50. In another aspect, shaft 30 is free from all contacts from the area spanning between innermost seal ring 60 and innermost seal ring 62 (see FIG. 9).

Chamber 50 is defined by suction head 22. In one aspect head 22 is a weldment. In other aspects suction head 22 is a single-piece casting or casted element. In one aspect head 22 is made of cast iron. Head 22 may be made of different types of metal. In one aspect impellers 36, 38 are the same size or mirror images of each other, thus having the same or generally the same pumping characteristics. In other aspects the impellers 36, 38 may have different sizes or different pump characteristics.

Having the open waterway between respective impellers 36, 38 provides a flow efficiency not present in previous designs. The open waterway is an unobstructed direct-line path leading from one impeller to another. Such open waterway or direct path "P" allows the inlet flow to be self-adjusted based on the downstream characteristics rather than having a forced directional flow to separate impellers using separate inputs as with prior designs. Prior designs would not allow the fluid to pass to either impeller, thus lacking the flexibility to self-adjust based on downstream characteristics. A designer cannot always predict the most efficient flow paths, thus, allowing for an open waterway enhances the self-adjusting of the pump 20, 21. The open waterway tends to enhance a more efficient flow of liquid—supplying the liquid as needed and thus more likely to also avoid a cavitation event.

In other aspects suction head 22 may include deflectors or grooves within chamber 50 to deflect or influence the flow of fluid. For instance, a deflector may include a projection extending from an inner wall of head 22 which acts to guide or influence the fluid to one of the impellers 36, 38 as compared to the other. A series of deflectors may be included. Deflectors may also include grooves (peaks and valleys) defined by the inner surface of suction head 22. In one aspect the deflector or deflectors do not mandate fluid to exclusively flow to a single impeller. Fluid approaching or contacting a deflector to influence the fluid to one impeller is not necessarily precluded from traveling into a suction inlet 42 of the other impeller. A deflector or projection is configured to only partially influence, as opposed to completely influence, fluid flow to one of the impellers. The deflector or deflectors define more than one fluid flow path to each of the impellers 36, 38. In one aspect, common inlet chamber 50 is devoid of an exclusive fluid pathway to the impellers 36, 38. While a deflector might influence the flow of the fluid, unlike prior designs the fluid is nonetheless not directed exclusively to one impeller or the other.

Figure 4:
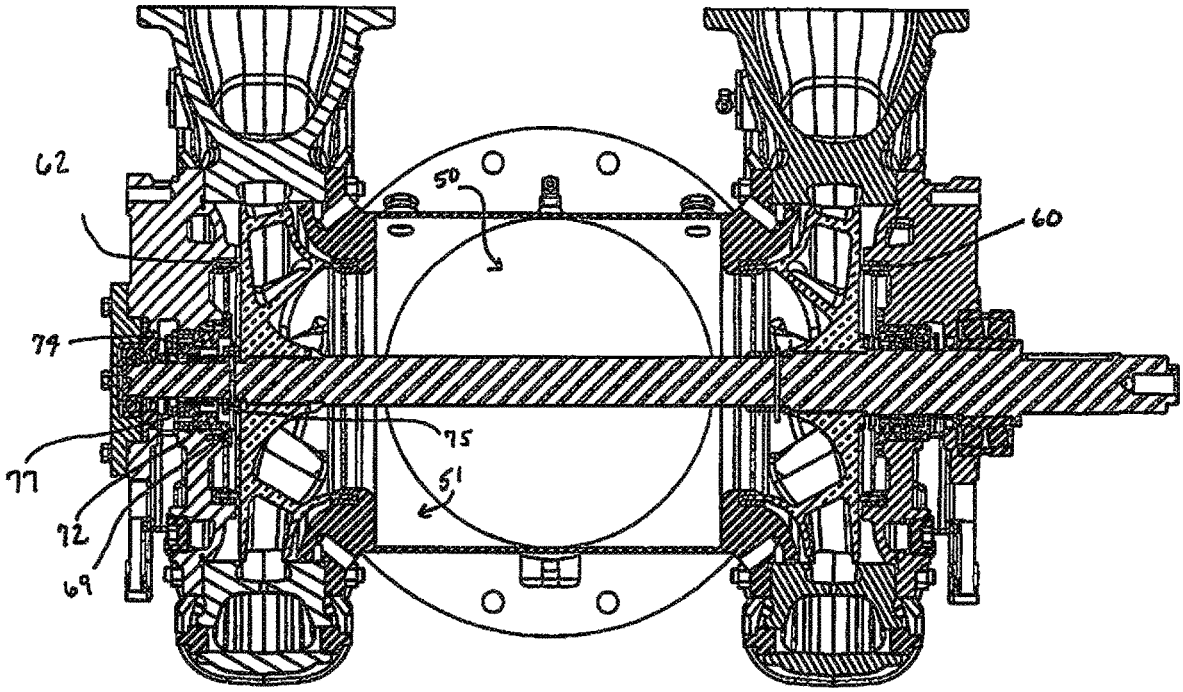
FIG. 4 is a section view taken along line 4-4 of FIG. 3.
Figure 5:
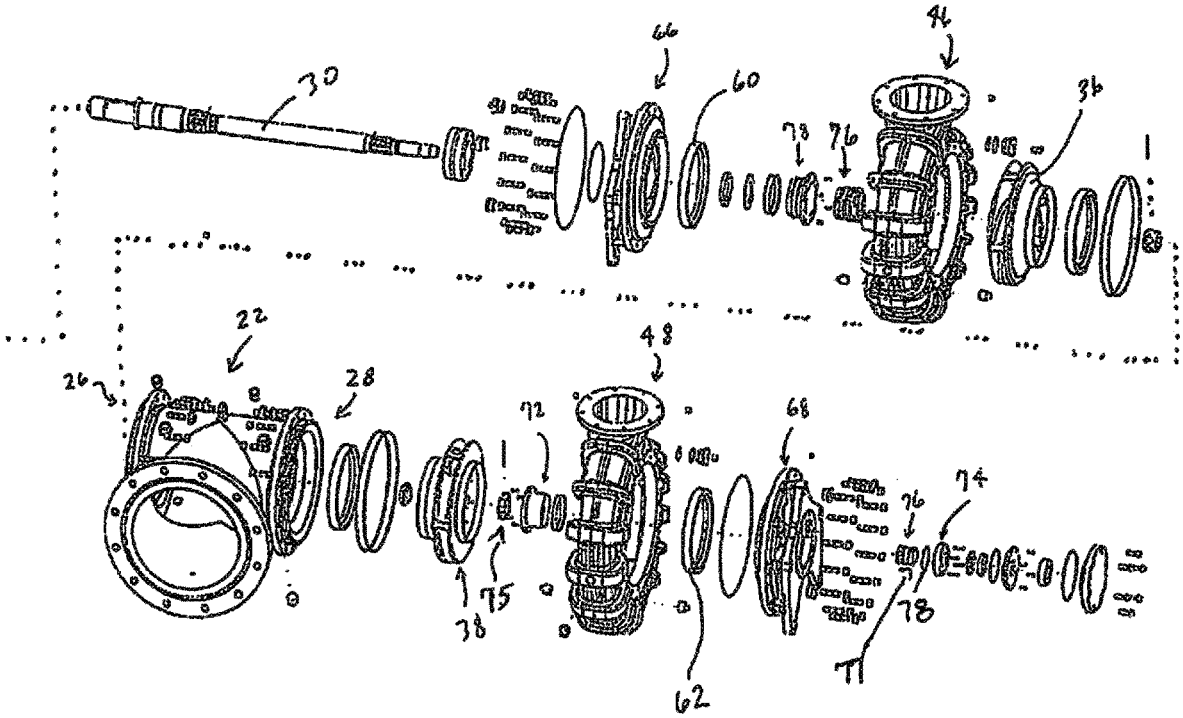
FIG. 5 is an exploded perspective view of the pump of FIG. 1.
Figure 6:
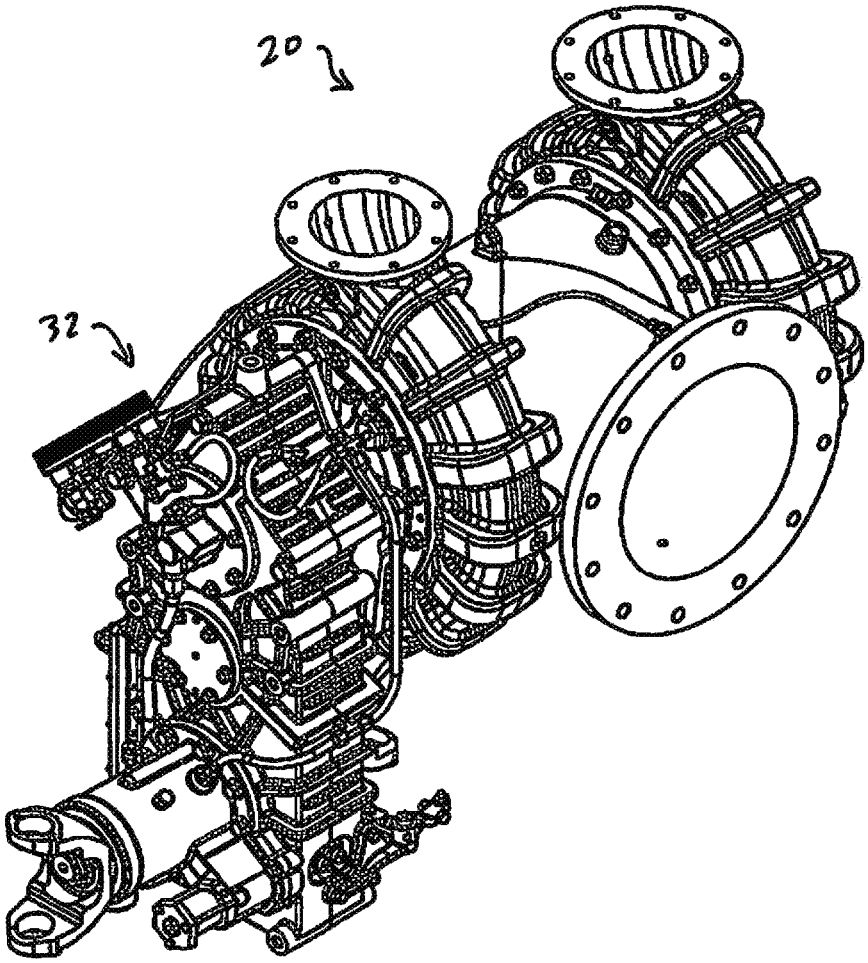
FIG. 6 is a perspective view of a pump in accordance with a further aspect of the invention.

As shown with reference to FIG. 4 and FIG. 5, pump 20 includes at least one seal ring 60. Seal ring 60 is configured to fit within a pocket 61 (FIG. 2) defined by an inboard head 66. Seal ring 62 is configured to fit within a pocket 63 defined by an outboard head 68. In one aspect, seal ring 60, 60' defines a groove 65 (See FIG. 2) into which an impeller flange 37, 37' of the first impeller 36 inserts. The second impeller 38 also has a flange 39 39' (FIG. 2) which inserts into a groove 65' of seal ring 62 62'. Such seal rings may be replaced upon wear. The groove 65 defined by seal ring 60 into which flange 37' inserts, opens to face the groove 65' defined by seal ring 62'. The flange 37' of impeller 36 extends toward the flange 39' of impeller 38. As further shown in FIG. 2, impeller 36 includes a cover piece 71 and a back piece 73. The flange 37' of the cover piece 71 of impeller 36 is positioned within the groove 65 of the seal ring 60'. As may be appreciated, impeller 36, 38 also includes blades 67 positioned between back piece 73 and cover piece 71.

Figure 7:
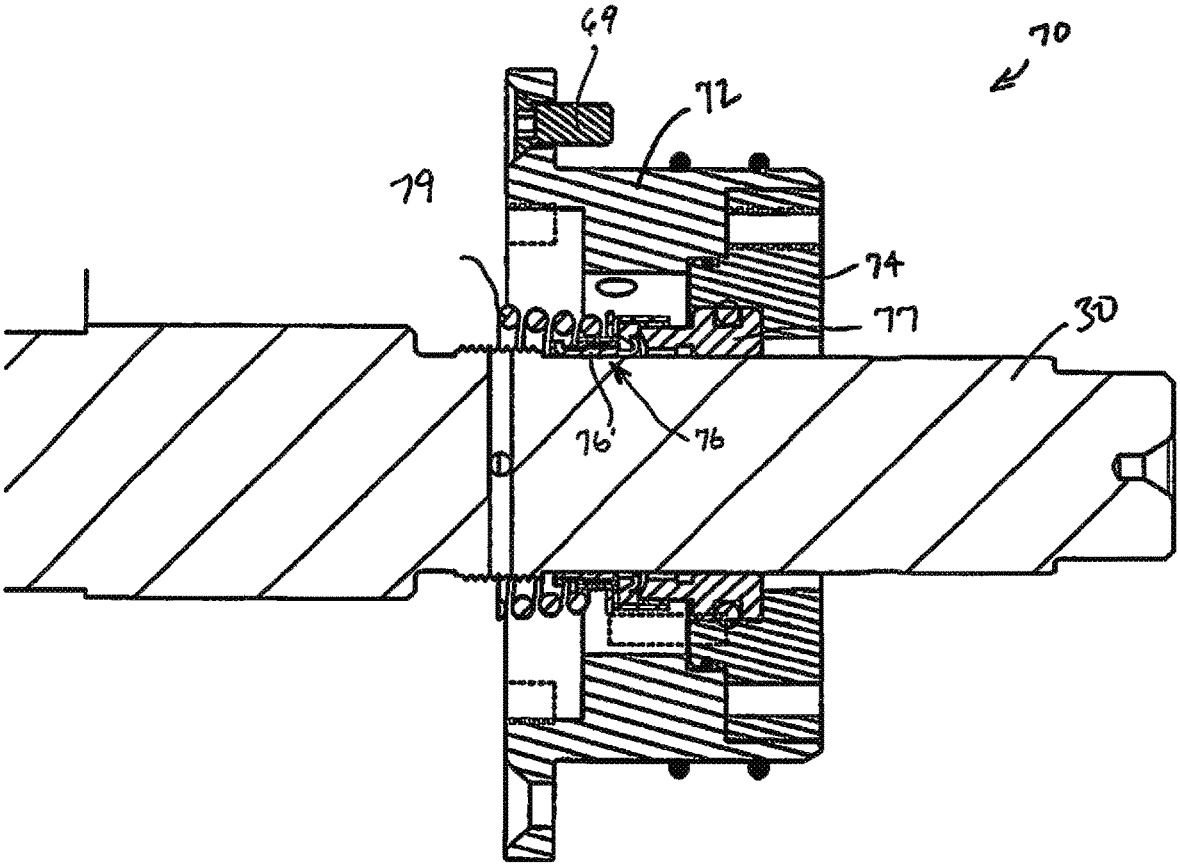
FIG. 7 is a partial close-up cross section view of components for use in conjunction with the present invention.

Referring to FIG. 5 and FIG. 7, a further aspect of the present invention includes a mechanical seal 70. Seal 70 has a two-piece housing having a first cup component 72 and a second cover component 74. Cup 72 is mounted to outboard head 68. In one aspect cup 72 is mounted to an inside portion of outboard head 68 with fastener 69 (FIG. 2, FIG. 7). A spring seal 76 is connected to cover 74 via stationary or mating ring 77. Mating ring 77 includes an O-ring, for instance, between ring 77 and cover 74. Cover 74 (together with spring seal 76) is then carefully passed over shaft 30 so that the components do not touch shaft 30 to avoid scratches or other damage to spring seal 76. Otherwise, the presence of scratches at seal 76 would tend to allow fluid, or too much fluid, to pass through seal 70 which would lead to early failure of the seal 70. Spring seal 76 is configured with a spring 79 to apply pressure from nut 75 forcing plate 76' toward mating ring 77 and cover 74. As water pressure builds, water (or water vapor) may pass between plate 76' and shaft 30. While seal 70 is designed to allow fluid to pass, such fluid will evaporate as designed; yet providing too much fluid to pass will or can tend to result in some fluid passing without evaporation (which leads to other problems). A seal 70 having a two-piece housing has an advantage for easier assembly and other benefits. If a single-piece housing were used at the outboard head 68, such as with single-piece seal 78, which is used on the inside of inboard head 66 (See FIG. 2 and FIG. 5), the outboard head 68 would need to be reconfigured with a wider diameter opening to allow insertion of such one-piece seal. Setting such seal would also be more difficult because it would have to slide over the shaft while fitting through the outboard head (at the risk of scratching or otherwise damaging spring seal 76). Additionally, use of the two-piece seal housing (cover 74 fastened to cup 72 with fasteners) allows for easier removal of an associated mating ring 77 with less possibility of damage to the mating ring 77 or other features of the pump. A further benefit of the two-piece housing for seal 70 is that the mating ring 77 may also be removed without having to remove outboard head 68.

In further aspects the pump includes a mechanical seal associated with the outboard impeller where the mechanical seal is positioned within a two-piece housing, the housing having a first cup component mounted with fasteners to an inboard side of the outboard head and a second cover component mounted to the first cup component with fasteners. A weld spring contained within the 2-piece housing, when in contact with the mechanical seal pilot nut 75 (shown in FIG. 4), creates the necessary force to seal components 76 and 77 (shown in FIG. 7). Such two-piece housing facilitates efficient and accurate assembly of the outboard head while assuring a proper seal.

Figure 8:
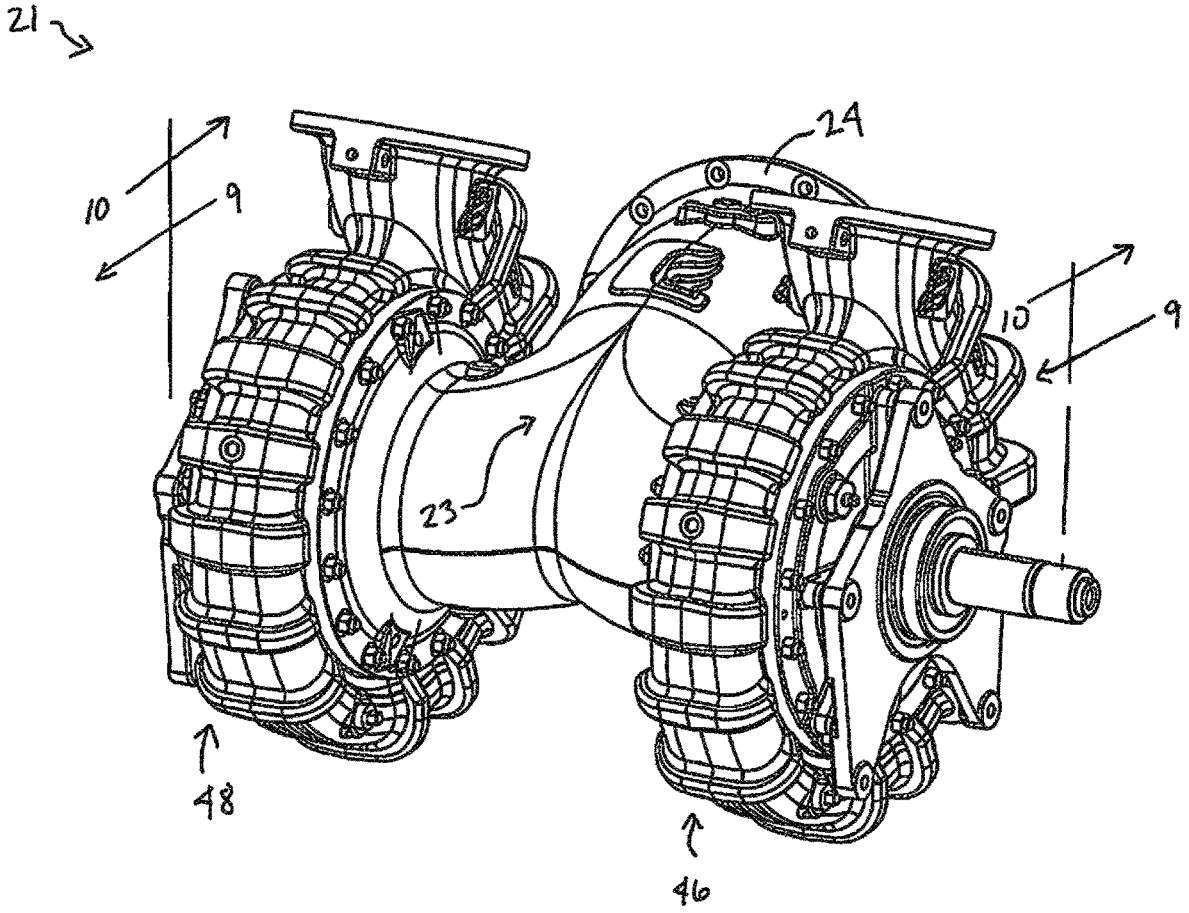
FIG. 8 is a perspective view of a pump in accordance with a further aspect of the present invention.
Figure 9:
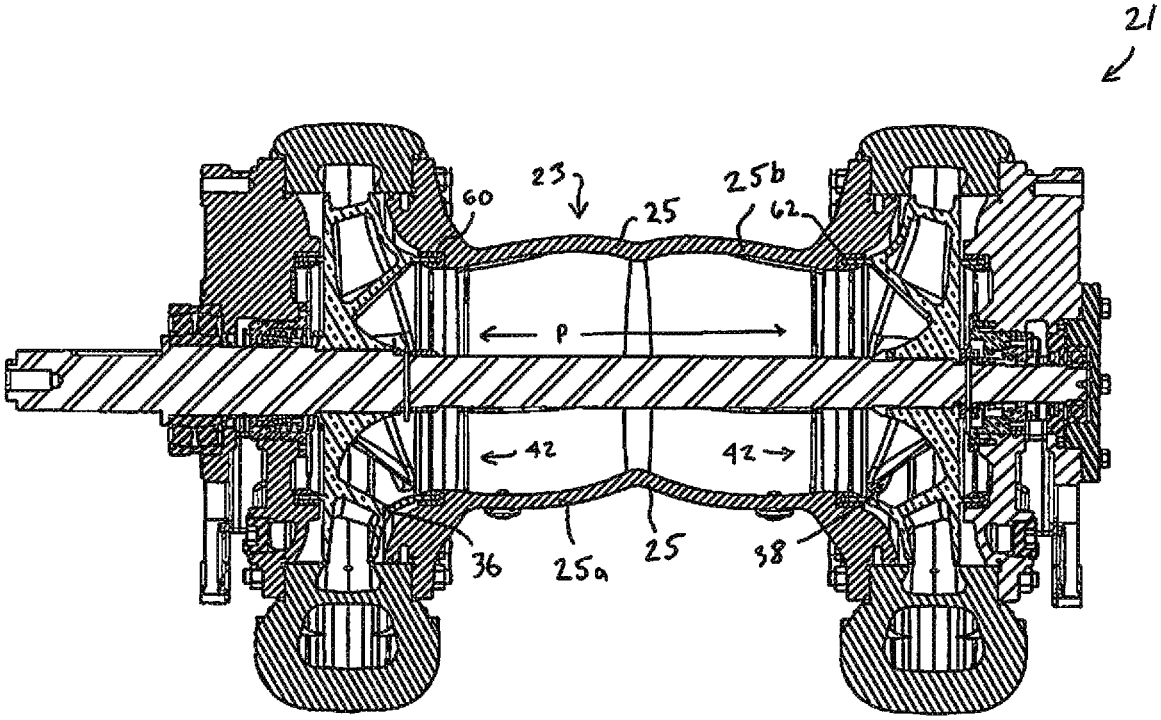
FIG. 9 is a section view taken along line 9-9 of FIG. 8.
Figure 10:
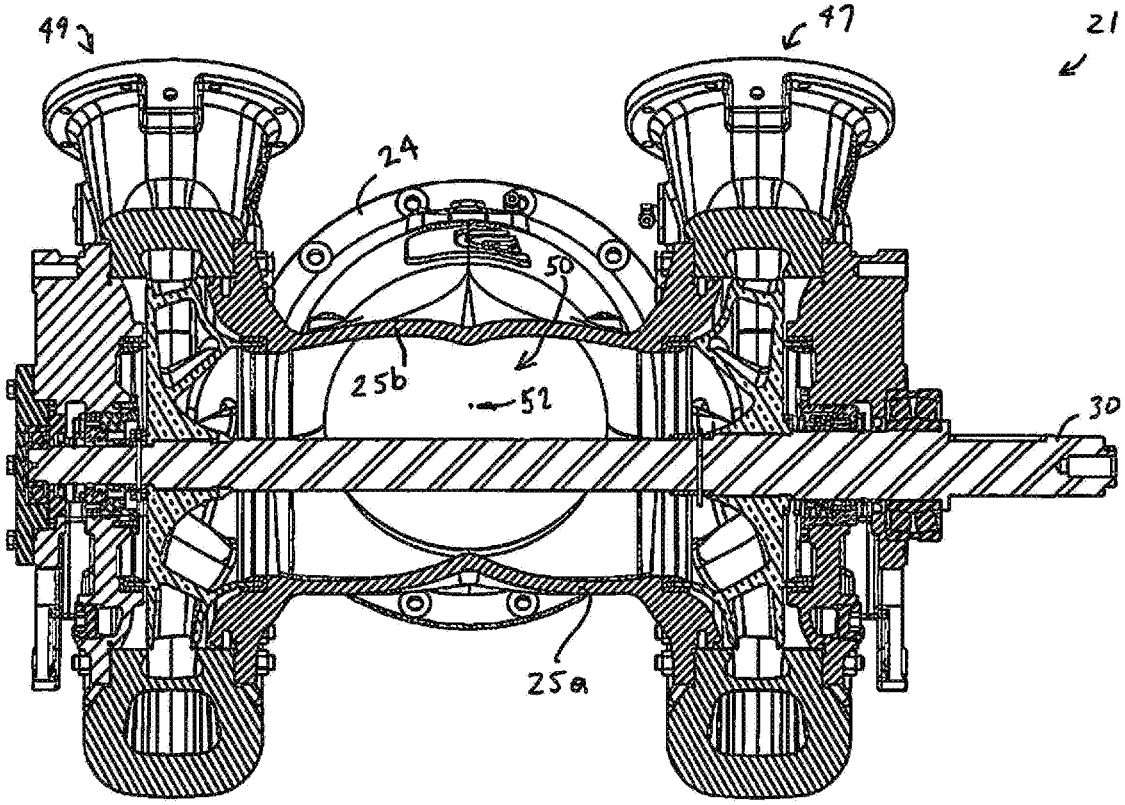
FIG. 10 is a section view taken along line 10-10 of FIG. 8.

Referring to FIGS. 8-10, a further aspect of the invention includes pump 21 having head 23. Head 23 is contoured as compared to head 22 in that walls 25*a*, 25*b* align with respective suction inlets 42. In one aspect suction head 23 is a one-piece iron casting. Particularly, wall 25*a* (FIG. 9) is configured to provide a smooth path directly from chamber 50 to suction inlet 42 and impeller 36. Such direct path allows for efficient feed of water from chamber 50 to enter impeller 36, 38 without abutting sharp edges or having to make abrupt direction changes as with suction head 22 which includes chamber corners 51 (See FIG. 4). Head 23 is contoured to influence efficient flow of water. While wall 25 may include undulations to influence the flow of water, the water is nonetheless free to flow according to the path of least resistance (or toward the path of greater suction) such that water in chamber 50 achieves a natural flow balance or direction depending on the demands or characteristics at the respective discharge 47, 49 or downstream of such discharges. For instance, water in chamber 50 may enter toward impeller 36 but due to the internal dynamics of the operation in some circumstances, the water will be free to be drawn to or through impeller 38. Water that contacts shaft 30 is free to travel to either of the respective impellers 36, 36. Such flexibility due to the shared input provides a more efficient water balance to the operation of the dual pump. As shown in FIG. 9, seal ring 60 (which receives flange 37 of impeller 36 is positioned within head 23 and is positioned at or near the same horizontal location as wall 25. The same wall 25 also receives seal ring 62 at an opposite side of pump 21.

As shown in FIG. 10, in one aspect head 23 and chamber 50 is configured with an offset orientation with respect to drive shaft 30 and the center of impellers 36, 38. For instance, a center-point 52 (through which is defined a center horizontal axis), which is a center point defined by the circular flange 24, is off-set from shaft 30. Center-point 52 also defines a center horizontal axis of head 23. In this manner, the center point of chamber 50 is also positioned above the centers of the impellers 36, 38. Because water tends to settle downward, having the shaft 30 positioned at a lower portion of chamber 50 provides a more natural feed or flow of fluid to the impellers 36, 38. Such offset tends to improve the fluid lift for pumping.

A further aspect of the invention includes a method of displacing fluid by utilizing the pump 20, 21 as described.

It should be understood that the foregoing relate to exemplary embodiments and aspects of the invention and that modifications may be made without departing from the spirit and scope of the invention as set forth in the following claims.

What is claimed is:

1. A centrifugal pump comprising:

a suction head;

a first single suction impeller positioned at a first end of the suction head and configured to be axially fed via a first single suction inlet;

a second single suction impeller positioned at a second end of the suction head and configured to be axially fed via a second single suction inlet; and a drive shaft passing through the suction head and configured to drive the impellers to simultaneously actively displace fluid, the first single suction inlet and the second single suction inlet configured to be axially fed via a single common inlet chamber defined by the suction head, a direct line path defined between the first impeller and the second impeller, the direct line path having a width at least 10% greater than a maximum diameter of the drive shaft.

2. The pump of claim 1 where the chamber is devoid of a fluid pathway configured to feed only one of the impellers.

3. The pump of claim 1 where the suction head is configured such that fluid entering the suction head and contacting the drive shaft is free to travel to either the first impeller or the second impeller.

4. The pump of claim 1 where an entirety of the drive shaft positioned between an innermost seal ring associated with the first impeller and an innermost seal ring associated with the second impeller is exposed within the inlet chamber, the innermost seal ring associated with the first impeller having a groove in which is positioned a flange of the first impeller.

5. The pump of claim 1 where the inlet chamber defines the direct line path between the first impeller and the second impeller.

6. The pump of claim 1 where the single suction inlet of the first impeller faces the single suction inlet of the second impeller.

7. The pump of claim 1 where the suction head includes a circular flange defining a horizontal center axis of the chamber, the drive shaft being offset from the center axis.

8. The pump of claim 1 further comprising a mechanical seal affixed to the drive shaft, the mechanical seal comprising a two-piece housing having a cover fastened to a cup, the cup fastened to an inside portion of an outboard head of the pump by a fastener passing through the cup and into the outboard head, an entirety of the fastener positioned at an inside of the outboard head.

9. The pump of claim 1 where a flange of the first impeller is positioned within a groove of a first innermost seal ring and a flange of the second impeller is positioned within a second innermost seal ring, an entirety of the drive shaft positioned between the first innermost seal ring and the second innermost seal ring is exposed within the inlet chamber.

10. The pump of claim 1 where the first impeller is configured such that all fluid received by the first impeller is received from the common inlet chamber.

11. The pump of claim 1 where the impellers are configured to displace liquid, the direct line path being an unobstructed direct line path.

12. The pump of claim 1 where the impellers simultaneously displace fluid in a same direction.

13. A centrifugal pump comprising:

a first impeller positioned on a drive shaft and having a suction inlet and an impeller flange, the impeller flange spins within a groove of a first seal ring, the first seal ring positioned within a pocket defined by an inboard head;

a second impeller positioned on the drive shaft having an impeller flange which spins within a second seal ring, the second seal ring positioned within a pocket defined by an outboard head, the second impeller having a suction inlet facing the suction inlet of the first impeller, the outboard head fastened to a pump casing in which the second impeller is positioned; and a suction head positioned between the impellers, the suction head defining a direct line path extending within the suction head between the first impeller and the second impeller.

14. The pump of claim 13 where the first impeller is configured such that all fluid received by the first impeller is received from the common inlet chamber.

15. A centrifugal pump comprising:

a suction head;

a first single suction impeller positioned at a first end of the suction head, the first single suction impeller having a back piece and a cover piece, a plurality of blades positioned between the back piece and the cover piece, the cover piece having a flange, a seal ring positioned in the suction head and defining a groove in which the flange is positioned;

a second single suction impeller positioned at a second end of the suction head; and a drive shaft passing through the suction head and configured to drive the impellers, the impellers configured to be fed via a common inlet chamber defined by the suction head, the common inlet chamber defining a direct line path, the first impeller and the second impeller configured such that all fluid received by the first impeller and the second impeller is received from the common inlet chamber.

16. The pump of claim 15 where the common inlet chamber is configured to axially feed the first impeller via a first suction inlet and to axially feed the second impeller via a second suction inlet, the direct line path defined between the first suction inlet and the second suction inlet.

17. The pump of claim 15 where the first impeller is positioned within a first pump casing having a first discharge outlet and the second impeller is positioned within a second pump casing having a second discharge outlet, fluid discharged from the pump via the first discharge outlet is separate from fluid discharged from the pump via the second discharge outlet.

18. The pump of claim 15 where the flange extends from the cover piece opposite the blades.

19. The pump of claim 18 where the flange is a circular flange.

20. The pump of claim 15 where the first single suction impeller has a flange extending from the back piece opposite the blades.

21. The pump of claim 15 where the flange extends from the cover piece opposite the blades and further comprising a flange extending from the back piece opposite the blades.

22. A centrifugal pump comprising:

a suction head;

a first impeller positioned at a first end of the suction head and configured to be axially fed via a first single suction inlet;

a second impeller positioned at a second end of the suction head and configured to be axially fed via a second single suction inlet;

a drive shaft passing through the suction head and configured to drive the impellers, the first single suction inlet and the second single suction inlet configured to be axially fed via a single common inlet chamber defined by the suction head, a direct line path defined between the first impeller and the second impeller; and a mechanical seal affixed to the drive shaft, the mechanical seal comprising a two-piece housing having a cover fastened to a cup, the cup fastened to an inside portion of an outboard head of the pump, the cover positioned at an outside portion of the outboard head.

23. A centrifugal pump for pumping liquid, the pump comprising:

a suction head;

a first single suction impeller positioned at a first end of the suction head, the first single suction impeller having a back piece and a cover piece, the first impeller having a flange, a seal ring positioned in the suction head and defining a groove in which the flange is positioned, a plurality of blades positioned between the back piece and the cover piece configured to displace liquid;

a second single suction impeller positioned at a second end of the suction head, the second single suction impeller having a back piece and a cover piece, a plurality of blades positioned between the back piece and the cover piece configured to displace liquid; and a drive shaft passing through the suction head and configured to drive the impellers, the impellers configured to be fed liquid via a common inlet chamber defined by the suction head, the common inlet chamber defining a direct line path between the first impeller and the second impeller.

24. A centrifugal pump for pumping liquid, the pump comprising:

a suction head;

a first single suction impeller positioned at a first end of the suction head and configured to be axially fed liquid via a first single suction inlet;

a second single suction impeller positioned at a second end of the suction head and configured to be axially fed liquid via a second single suction inlet; and a drive shaft passing through the suction head and configured to drive the impellers to displace liquid, the first single suction inlet and the second single suction inlet configured to be axially fed via a single common inlet chamber defined by the suction head, an entirety of the drive shaft positioned between an innermost seal ring associated with the first impeller and an innermost seal ring associated with the second impeller is exposed within the inlet chamber, the innermost seal ring associated with the first impeller receiving an inwardly directed flange of the first impeller.

25. The pump of claim 24 where the innermost seal ring associated with the first impeller has a groove in which is positioned the flange of the first impeller and the innermost seal ring associated with the second impeller has a groove in which is positioned a flange of the second impeller, the flange of the first impeller extending toward the flange of the second impeller.

* * * * *